United States Patent [19]

Ackerman

[11] 4,222,504

[45] Sep. 16, 1980

[54] DRIP PREVENTIVE SPOUT PARTICULARLY ADAPTED FOR USE IN POURING WINES

[76] Inventor: Bernard Ackerman, 17 Stirling Ct., Metuchen, N.J. 08840

[21] Appl. No.: 898,873

[22] Filed: Apr. 21, 1978

[51] Int. Cl.[2] ..... B65D 5/74

[52] U.S. Cl. ..... 222/569; 222/571

[58] Field of Search ..... D9/253, 260, 275, 290; 220/85 SP, 90.4, 90.2, DIG. 5; 40/310, 311; 222/569, 571, 568, 563, 567, 108, 109; 526/329, 331; 215/100 R, 307; 141/331, 338, 337

[56] References Cited

U.S. PATENT DOCUMENTS

| | | | |
|---|---|---|---|
| D. 159,797 | 8/1950 | Gessler | D9/275 |
| D. 206,733 | 1/1967 | McPhee | D9/290 |
| 1,014,486 | 1/1912 | King | 40/310 |
| 1,967,984 | 7/1934 | Wolcott | 99/292 |
| 2,785,841 | 3/1957 | Westgate | 215/100 R |
| 3,074,581 | 1/1963 | Livingstone | 215/100 |
| 3,179,290 | 4/1965 | Whitney | 222/571 |
| 3,211,195 | 10/1965 | Porter | 220/85 SP |
| 3,422,998 | 1/1969 | Murray | D9/290 |
| 3,884,857 | 5/1975 | Ballard et al. | 526/331 |

*Primary Examiner*—H. Grant Skaggs

*Attorney, Agent, or Firm*—Lackenbach, Lilling & Siegel

[57] ABSTRACT

A drip preventive spill-proof spout comprised of a highly water-repellant elastomer material, such as natural or synthetic rubbers, the preferred material being silicone rubber. The spout is particularly adapted for use with wine bottles, the mouths of which are not standardized. The elastomeric quality of the device enables it to be fitted to a large variety of wine bottles. The spout comprises a funnel formed at an angle of approximately 45° to a horizontal line, thus making for maximum efficient drop retention and return of the residue to the bottle. The angle of the funnel relative to the horizontal or the vertical creates or gives rise to a sharp pouring edge over which each drop of wine must pass when the wine is being poured from the bottle into a glass. This edge and the material from which this spout is made are critical to the operability of the present invention. The material, preferably silicone rubber, causes the wine, which is mostly water, to "bead up" on the surfaces of the spout. The stem of the spill-proof spout is stepped. This feature, taken in conjunction with the elastomeric qualities of the material from which the spout is made, enables it to be fitted to a large variety of wine bottles.

6 Claims, 4 Drawing Figures

DRIP PREVENTIVE SPOUT PARTICULARLY ADAPTED FOR USE IN POURING WINES

BACKGROUND OF THE INVENTION

This invention relates to a spill-proof or drip preventive spout particularly adapted for use in pouring wines. The spout is fabricated of a highly water-repellant elastomer material, such as natural or synthetic rubbers. The preferred material is silicone rubber. The elastomeric qualities of the spout enables it to be fitted to a large variety of wine bottles, the mouths of which are not standardized.

More wine is being consumed in this country than ever before, Indeed, wines have become a hobby for many, one's knowledge of wines adding to the enjoyment of purchasing them, collecting them and, of course, serving them to one's self or to guests. A wine need not be expensive to bring enjoyment to the connoisseur. However, much machination goes into the pouring of wines so that, in the case of the perfectionist, not a single drop is allowed to spill onto a table.

Until the advent of the present invention, there has been and remains available a double pouring spout that is silver plated over a base metal. When wine is poured, it runs over the upper spout. The residue is caught by the lower spout and is returned to the bottle. This double pouring spout is expensive, unsightly in use and, more importantly, does not always work.

The seminal version of the present invention did not comprise a funnel. It was flat at the horizontal plane of the top of the spout. Thus, there was no sharp edge within the meaning and scope of the present invention and no funnel portion. This earlier version, which was first used in August of 1976, did not promote the return of the wine at the top of the spout to the bottle. This version also did not comprise other of the features of the spill-proof spout disclosed and claimed in this application. The only common denominator was the material from which this seminal version was made.

SUMMARY OF THE INVENTION

Accordingly, it is an object of the present invention to provide a spill-proof spout particularly adapted for use in pouring wines. It is intended herein that "spill-proof" means drip preventing or elimination as the spout of the present invention does allow for pouring liquid there-through in a readily controlled manner without undesired trickling of the liquid.

Another object of the present invention is to provide a spill-proof spout particularly adapted for use in pouring wines fabricated of a highly water-repellant elastomer material, such as natural or synthetic rubbers, the preferred material being silicone rubber. The elastomeric qualities of the spill-proof spout of this invention enables it to be fitted to a large variety of wine bottles, the mouths of which are not standardized.

Yet, another object of the present invention is to provide a spill-proof spout particularly adapted for use in pouring wines that is fabricated of a highly water-repellant elastomer material, such as natural or synthetic rubbers, the preferred material being silicone rubber. The spout comprises a neck or stem which is stepped. This feature, taken in conjunction with the elastomeric quality of the material from which the spout is fabricated, enables it to be fitted to a large variety of wine bottles.

A further object of the present invention is to provide a spill-proof spout particularly adapted for use in pouring wines, the spout being comprised of a funnel that forms an angle in a preferred form of the invention of forty-five (45) degrees to the horizontal. The funnel is located in the crown of the spout. A sharp edge is defined by the intersection of the funnel with the vertical wall of the crown. This sharp edge and the funnel cooperate with one another to provide for maximum efficiency in drop retention, thus insuring the return of virtually every drop of wine to the bottle that has not been poured into a glass. Expressed otherwise, the material from which the spout is fabricated is water repellant; as wine is being poured, the bottle is tilted towards a glass-type receptacle for the wine; when the glass nears being filled, the pourer begins to right the bottle of wine; the hydrophobic or water repellant characteristic of the material of the spout causes the wine, which is mostly water, to "bead up" on the surface of the spout; the last drops hang on the edge until the bottle is completely righted; and, as the bottle of wine nears a vertical attitude, the funnel functions to effectively return all of the wine that has not been poured to the bottle from whence it came.

Thus, the spill-proof spout of the present invention prevents any drop of wine from being spilled onto a table. It is not necessary for the pourer to take any precautionary measures such as twisting the bottle of wine, or wrapping the neck of the bottle in a towel, or otherwise attempting to prevent spillage.

Still further, it is an object of the present invention to provide a spill-proof spout particularly adapted to be used in pouring wines, the spout being fabricated of a highly water-repellant elastomer material so that the spout can be cleaned by simply rinsing it in warm water. Even if the spout becomes stained by red wines, its properties will not be affected. To remove the stains, the spout of the present invention can be washed in a dishwasher or it can be soaked overnight in a dilute solution of powdered dishwashing detergent.

The use of the spill-proof spout of the present invention is quite simple. The cork of the conventional wine bottle is removed in the usual way. The neck of the wine bottle may vary in its diameter, because wine bottles are not standardized from one to the next. However, the stem of the spill-proof spout of this invention is stepped so that, this feature taken in conjunction with the elastomeric qualities of the material from which it is made, enables the spout to be inserted into the neck of virtually any wine bottle. Moreover, there is a gradual transition from the stem to the crown so that, when the spout of this invention is removed from a bottle of wine, it will not be torn at this location. Once the spout is inserted into a bottle of wine, it is only necessary to tilt the bottle and pour the wine at a moderate rate. Rotation of the bottle is unnecessary, as is wrapping the bottle in a towel or taking other precautions.

The present invention will be better understood and the objects and important features, other than those specifically enumerated above, will become apparent when consideration is given to the following detail and description. The description, when taken in conjunction with the drawing, describes, discloses illustrates, and shows a preferred embodiment of the present invention and what is presently considered and believed to be the best mode of practicing this invention. Other embodiments or modifications may be suggested to those having the benefit of the teachings herein and such other embodiments or modifications are intended to be reserved especially as they fall within the scope and spirit of the subjoined claims.

DESCRIPTION OF THE PREFERRED EMBODIMENT

Figure 1:
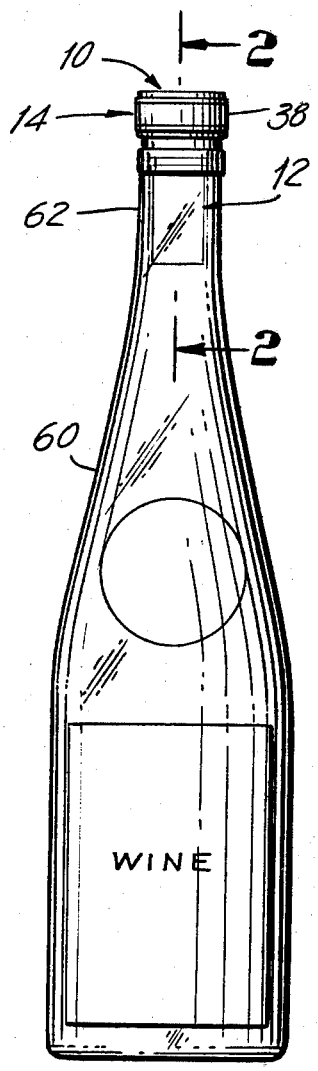
FIG. 1 is an elevational view of a bottle, for example, a wine bottle, illustrating the spill-proof spout of the present invention in operative association therewith.

Referring now specifically to the drawings, in which identical or similar parts are designated by the same reference characters throughout, the spill-proof or drip preventive spout of the present invention is generally designated by the reference character 10. It is comprised of a stem generally designated by the reference character 12 and a crown generally designated by the reference character 14.

It is important, at this point, to realize that the preferred embodiment of the present invention is fabricated of a highly water-repellant elastomer material. This material can be a natural or synthetic rubber, the preferred material being a silicone rubber. The elastomeric qualities of this material enables it to be fitted to a large variety of wine bottles, the mouths of which are not standardized. In addition, as already stated, natural or synthetic rubbers, such as silicone rubber, are water-repellant. This characteristic is very important to the extremely efficient operation of the spill-proof spout of the present invention because it causes the wine, which is mostly water, to "bead up" on the surface of the spout.

The stem 12 comprises a wall 16 that defines a passageway 18. The wall 16 is defined by an outer surface 20 and inner surface 22.

The inner surface 22 extends vertically from the bottom 24 of the stem 12 to a location 26 approximately midway of the height of the crown 14. The outer surface 20 of the wall 16 of the stem 12 extends vertically to a location or region 28 at which the stem 12 is stepped outwardly from the diameter of the outer surface 20 to an outer surface 30. The number of steps between the location or region 28 and the outer surface 30 is not critical to the present invention. However, it is important that the stem 12 be stepped because this feature, taken in conjunction with the elastomeric qualities of the material from which the spout 10 is fabricated, introduces a flexibility that enables the spout to adjust and to be fitted to a large variety of wine bottles. It is considered well known that the mouths of wine bottles are not standardized.

The stem 12 is integral with the crown 14, the two being joined by a radius 32. This feature of the present invention enables the spout to be withdrawn from a wine bottle easily while, at the same time, minimizing the possibility of tearing. It has been found that a junction of ninety (90) degrees between the stem 12 and the crown 14 of the spout 10 of the present invention greatly increases the chances of tearing at this juncture when the spout is removed from a wine bottle.

The crown 14 is comprised of a bottom wall 34, a top wall 36, and a side wall 38. The side wall 38 also defines the outer wall of the crown. The inner wall 40 of the crown 14 is defined by the upper reaches of the inner surface of wall 22 of the stem 12. As previously stated, this vertical wall or surface ends at a location 26 approximately mid-way of the height of the crown, at which this wall or surface turns outwardly. There is thus defined a wall, surface or conical portion 42 that functions as and will be called a funnel. The surface or wall 42 forming the funnel defines an acute angle with a horizontal line that is coplanar with the top 36 of the crown 14. This acute angle should be no less than thirty (30) degrees. Preferably, the angle should be forty-five (45) degrees. This acute angle cannot exceed sixty (60) degrees, the upper limit of the angle being limited by mechanical and geometric considerations in the manufacture, by molding techniques, of the spill-proof spout of the present invention.

The crown 14 comprises a sharp edge 46 that is defined by the surface 42 of the funnel with the horizontal upper surface 36 of the crown 14 and the vertical wall or surface 38. This sharp edge 46 is critical to the efficient operation of the spout of the present invention, in particular, preventing spill-over of wine. The funnel, too, is critical to the efficient operation of the present invention, promoting the return of wine in the crown, more particularly, in the upper reaches of the passageway 18 and in the area defined by the funnel back into the bottle. As already described, a bottle of wine is tilted and the wine poured through the spout 10 at a moderate rate. When the pourer decides that a glass is properly filled, the wine bottle is righted. The sharp edge 46 literally cuts the stream of wine, the ability of the edge to perform this function being enhanced by the hydrophobic or water repellant characteristic of the material, preferably silicone rubber. This characteristic causes the wine, which is mostly water, to "bead up". The wine at the edge 46 hangs there until the wine bottle is righted. Then, the funnel 42 promotes the return of the wine in the crown back into the bottle. The sharp edge 46, the funnel 42 and the water-repellant characteristics of the material all contribute to insuring that virtually not a single drop of wine is allowed to be spilled on a table top. It is not important to twist the bottle of wine as the wine is being poured. It is not important to use other precautionary measures such as a towel. The spout 10 is completely efficient in preventing spill-over. The extension of the funnel portion at any point, measured along the surface thereof, is a distance not less than the smallest radius of the passageway 18.

The efficiency of the spill-proof spout 10 of the present invention will be appreciated to an even greater extent when one considers its use with a wine having a substantial amount of sediment, such as red wines. It is believed to be well known that red wines should be poured very slowly to decant the liquid, leaving the sediment in the bottle. In fact, red wines should be pourd very slowly to prevent the sediment from being dispersed generally throughout the wine. This can be accomplished virtually perfectly by the spill-proof spout of this invention because, as already stated, it is made from a material having hydrophobic qualities, thus causing the wine to "bead up" on the surface of the spout, especially the surfaces defining the funnel 42. No matter how slowly one pours the wine, and no matter what the angle of the bottle, no wine will run over the edge and down the outside of the bottle. The user can therefore see when the sediment is about to leave the bottle and enter the spout 10, and slow down even further the rate at which the wine is being poured. It is here, again, that the criticality of the sharp edge, as well as the criticality of the material from which the spout is made, comes into play. Additionally, the stepped configuration of the stem 12 is capable of creating a space between the outer surface 20 and the inner surface or diameter of the neck of a bottle of wine 60 as shown in FIG. 1. When wine is being poured from the bottle 60, sediment can be trapped in this space. This is yet another feature that contributes to the efficiency and near perfection by which the spout 10 of the present invention operates. The importance of these features becomes even more apparent when one considers the applicability of the present invention to those situations in which wine is decanted from its home, for example, a wine bottle such as the bottle 60 illustrated in FIG. 1 to a crystal or other equally decorative and fanciful decanter. Decorative decanters usually have a narrow mouth, and the importance of being able to pour accurately into the mouth of a decanter is essential. It is not only important to prevent any spilling of wine but to also insure that any sediment is precluded from being decanted from the bottle to the decanter. It has been found that the spout 10 of the present invention accomplishes these results for the reasons already stated.

Figure 2:
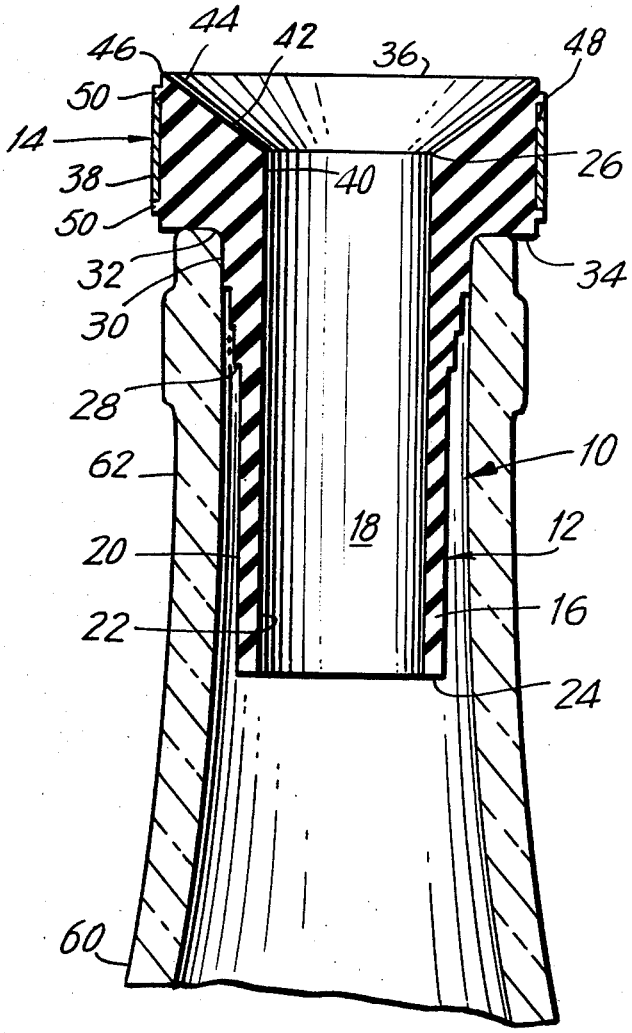
FIG. 2 is a cross-sectional view taken along the line 2—2 of FIG. 1.

The spill-proof spout 10 of the present invention can be made perfectly plain, without any adornment. As illustrated in FIGS. 1 and 2, however, the spout may comprise a decorative ring 48 that completely encircles the crown 14. This ring can be fabricated of any suitable material. For example, it can be chrome-plated steel. The ring may even be fabricated of sterling silver for those applications requiring a more elaborate wine spout. The decorative ring 48 can itself be quite plain, or, as illustrated, can be made so as to comprise decorative ribs or ridges. (Not shown). In either event, the ring 48 is held in position by ribs 50 that are integrally molded to the crown 14.

Figure 3:
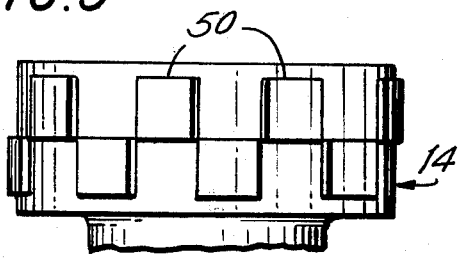
FIG. 3 is a partial elevational view of the spill-proof spout of this invention, illustrating in particular a modification of the crown portion thereof.
Figure 4:
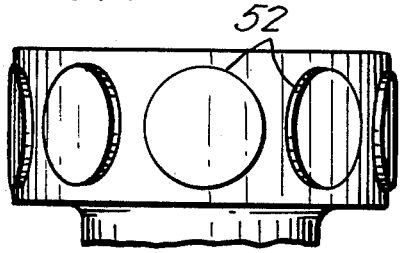
FIG. 4 is a view similar to that of FIG. 3 showing yet another modification of the crown.

In another embodiment of the present invention, particularly illustrated in FIG. 3 of the drawings, the crown 14 is illustrated as comprising decorative squares 52. This particular embodiment contemplates that the decoration of the crown 14 is accomplished by integrally molding these squares into the crown. In like manner, the crown 14 can be integrally molded with circular decorative elements 54 as illustrated in FIG. 4 of the drawings. It will, of course, be appreciated that the decorative elements comprised of the separate ring 48 of FIGS. 1 and 2 and the integrally molded decorative elements 52 of FIG. 3 and 54 of FIG. 4 are to be considered by way of example only. Numerous other decorative elements, both separately fabricated and to be assembled with the wine spout 10 of the present invention, as well as those that can be integrally molded into the crown 14, are well within the scope of the present invention.

As will be apparent to those skilled in the art, materials other than silicone rubber, which posses the necessary elastomeric and hydrophobic qualities already discussed, can be employed in the fabrication of the spill-proof spout.

For example, copolymers of polyolefins such as polyethylene, polypropylene, polybutenes and polystyrene with vinyl acetate, methyl acrylate or ethyl acrylate are suitable.

Although the present invention has been described in some detail by way of illustration and exmaple for purposes of clarity of understanding, it will of course be understood that various changes and modifications may be made in the form, details, and arrangements of the parts without departing from the scope of the invention as set forth in the following claims.

What is claimed is:

1. A removable and reusable drip preventive spout for liquid containers particularly adapted for use with wine bottles comprising an elongated stem and a superposed crown each having a passageway extending therethrough, the passageway in the crown extending outwardly forming a conical portion therein, a sharp pouring edge defined by the intersection of the upper edge of the conical portion with an outer surface of the crown, the surface of the conical portion forming an angle with a horizontal plane of approximately 45 degrees, the length of the shortest distance between upper and lower edges of the conical portion measured along the surface thereof at any location being not less than the length of the smallest radius of the passageway in either said stem or crown to facilitate controlled pouring of the liquid contents of the container, said stem and crown being integrally fabricated entirely of an elastomeric material and having the intersection of the stem and the crown rounded forming a radius to prevent tearing of the spout during removal, the outer side wall of the stem at the upper portion thereof forming a plurality of substantially annular flat surfaces of increasing diameters, said diameters increasing in size travelling upwardly towards said crown to enable the spout to form a liquid tight fit with the neck of liquid containers of varying diameters, and said elastomeric material being a silicone rubber.

2. A drip preventive spout as defined in claim 1, wherein the crown comprises decorative portions molded integrally with respect thereto.

3. A drip preventive spout as defined in claim 2, wherein the decorative portions are square in configuration.

4. A drip preventive spout as defined in claim 2, wherein the decorative portions are round in configuration.

5. A removable and reusable drip preventive spout for liquid containers particularly adapted for use with wine bottles comprising an elongated stem and a superposed crown each having a passageway extending therethrough, the passageway in the crown extending outwardly forming a conical portion therein, a sharp pouring edge defined by the intersection of the upper edge of the conical portion with an outer surface of the crown, the surface of the conical portion forming an angle with a horizontal plane of approximately 45 degrees, the length the shortest distance between upper and lower edges of the conical portion measured along the surface thereof at any location being not less than the length of the smallest radius of the passageway in either said stem or crown to facilitate controlled pouring of the liquid contents of the container, said stem and crown being integrally fabricated entirely of an elastomeric material and having the intersection of the stem and the crown rounded forming a radius to prevent tearing of the spout during removal, the outer side wall of the stem at the upper portion thereof forming a plurality of substantially annular flat surfaces of increasing diameters, said diameters increasing in size travelling upwardly towards said crown to enable the spout to form a liquid tight fit with the neck of liquid containers of varying diameters, and said elastromeric material being a copolymer of a polyolefin selected from the group consisting of polyethylene, polypropylene, polybutenes, copolymeric with a substance selected from the group consisting of vinyl acetate, methyl acrylate, and ethyl acrylate.

6. A drip preventive spout as defined in claim 1, wherein the crown comprises a decorative ring mounted separately thereupon.

* * * * *